US006666707B2

(12) United States Patent
Moret Codina

(10) Patent No.: US 6,666,707 B2
(45) **Date of Patent: *Dec. 23, 2003**

(54) UNIT FOR CONNECTING CONDUCTOR TERMINALS

(76) Inventor: Maria Cristina Moret Codina, Ferran Agulló No. 20 pral. 1ª, 08021 Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 10/002,564

(22) Filed: Nov. 1, 2001

(65) Prior Publication Data

US 2002/0074218 A1 Jun. 20, 2002

(30) Foreign Application Priority Data

Nov. 3, 2000 (ES) ..... 200002681

(51) Int. Cl.[7] ..... H01R 4/24

(52) U.S. Cl. ..... 439/441; 439/437; 200/51.1; 200/51.09

(58) Field of Search ..... 200/51.09–51.11, 200/51.12, 51.1; 439/188, 676, 441

(56) References Cited

U.S. PATENT DOCUMENTS

| | | | | |
|---|---|---|---|---|
| 2,713,668 A | | 7/1955 | Gibilisco | |
| 3,152,851 A | | 10/1964 | McLaughin | |
| 4,759,726 A | * | 7/1988 | Naylor et al. | 439/441 |
| 4,768,976 A | * | 9/1988 | Gelati | 439/441 |
| 5,915,991 A | | 6/1999 | Roman | |
| 6,146,187 A | | 11/2000 | Pallai | |
| 6,146,217 A | | 11/2000 | Osada | |
| 6,261,120 B1 | * | 7/2001 | Beege et al. | 439/268 |

FOREIGN PATENT DOCUMENTS

| | | |
|---|---|---|
| EP | 0 246 199 A2 | 11/1987 |
| JP | 01-130480 | 5/1989 |

* cited by examiner

*Primary Examiner*—Karl D. Easthom
*Assistant Examiner*—M. Fishman
(74) *Attorney, Agent, or Firm*—Micahel J. Striker

(57) ABSTRACT

A unit for connecting conductors to terminals having a body having a bottom, and devices for connecting two conductors to a same terminal and disconnecting one of the conductors without disconnecting the other conductor as well as connecting to the terminal one of the conductors and thereafter the other conductor also without the one conductor being affected, with acting on the conductors perpendicularly to the bottom of the body.

5 Claims, 7 Drawing Sheets

UNIT FOR CONNECTING CONDUCTOR TERMINALS

BACKGROUND OF THE INVENTION

The present invention relates to a unit for connecting conductors to terminals. More particularly, it relates to a unit for terminals of the kind which constitutes the central internal body of the electrical devices currently used, such as switches, pushbuttons, mounting plates and the like, a unit which is designed to allow connecting two conductors to a same terminal and to make possible disconnecting one of them without disconnecting the other as well as once of the two connectors is connected, to connect the second conductor without this affects the position of the first, all of it quite quickly and with full effectiveness and guaranty.

One of the tasks which presently requires special care and therefore have repercussions on the times for mounting the installations, is connecting the conductors to terminals which has a repercussion on the electrical device, and operation which requires, either an installation prior to the terminals, or an industrious hand folding or braiding around the setscrew itself on the terminal. These tasks will require more care when two conductors have to be connected to a single terminal, which is frequent enough in installation.

SUMMARY OF THE INVENTION

It is therefore an object of the present invention to provide a unit for terminals, which avoids the drawbacks of the prior art.

These drawbacks are overcome in a practical way by using the unit for terminals of this invention, which is provided with several mechanical devices by means of which immediate fastenings and setting is carried out and without any prior preparation of the clean ends of the conductors which have to be located within the receptacle of the connected terminal, allowing the quick and effective connection to the terminals of one or two conductors, as well as the optional disconnection of only one of them also providing that the access or repercussion of the ends of the cables is uprightly carried out, that is to say, perpendicularly to the bottom of the body itself and parallel to the unit longitudinal plane of symmetry.

The unit of terminals of the invention also provides that in a single unit several devices are arranged for quickly connecting the terminals, allowing that each of the said devices to place two cables for their connection to the terminals.

In keeping with these objects and with others which will become apparent hereinafter, one feature of present invention resides, briefly stated in a unit which has a body having a bottom; and means for connecting two conductors to a same terminal and disconnecting one of the conductors without disconnecting the other conductor as well as connecting to the terminal one of the conductors and thereafter the other conductor also without the one conductor being affected, with acting on the conductors perpendicularly to the bottom of the body.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
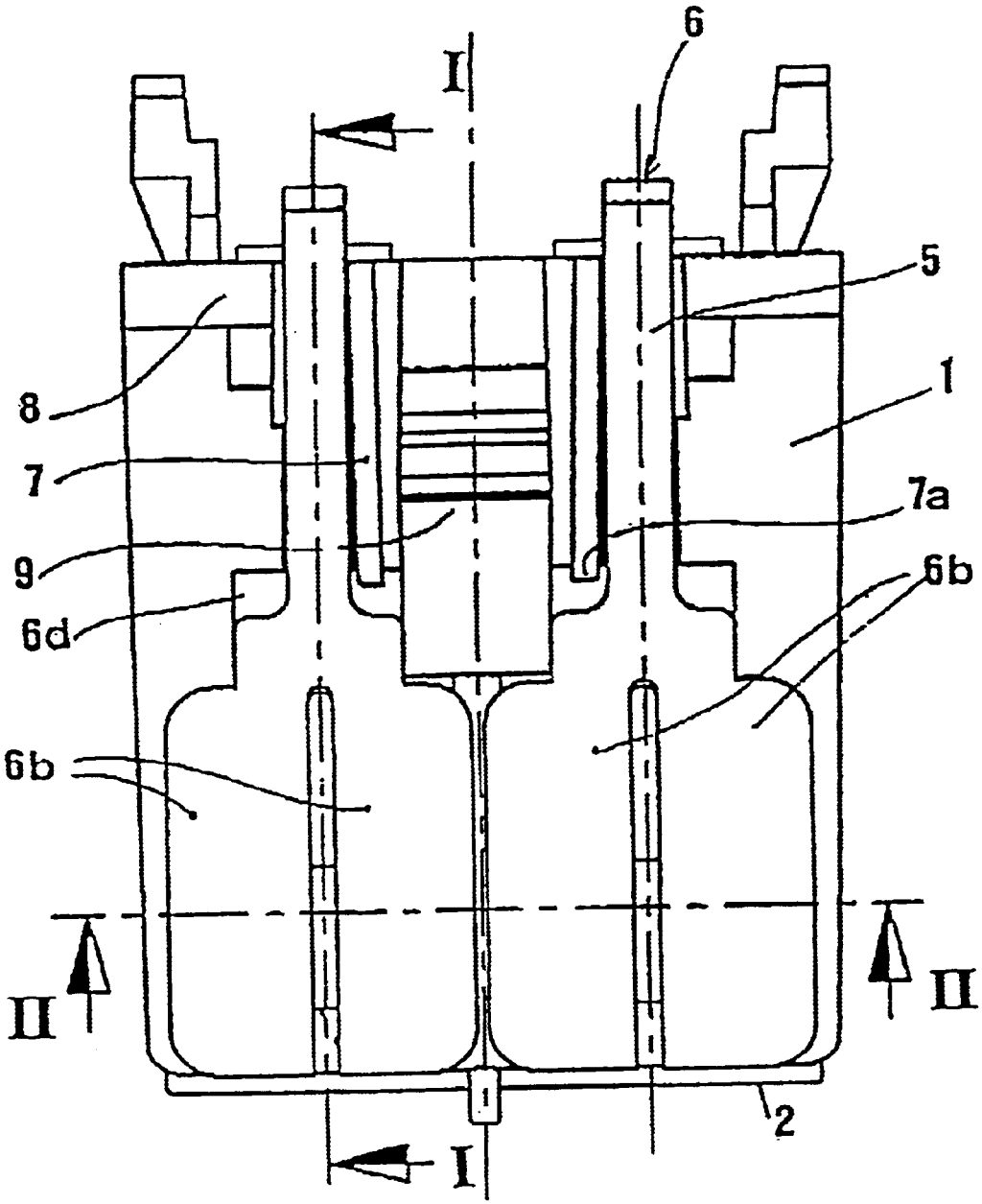
FIG. 1 is a front elevation view of the body constituting the unit of terminals.

A unit of terminals provided with quick connection to terminal devices in accordance with the present invention constituted by a rectangular prismatic body 1, having a sensibly flat and horizontal bottom 2, which has available at its top part a plate 3 having upright protuberances 4 which constitute the rounded point for setting and swinging the operating lever 5, through the slot 6*a* it possesses at its top head 6.

The interior of the body 1 is constituted by a series of walls which configure the housings for the elements of the electrical element to which will be coupled the body of the unit of terminals.

Upright external small walls 7, close to the top flanges 8, constitute the area for locating the operating levers 5, completed by the triangular central protuberance 9, located on the longitudinal plane of symmetry.

At the lower part of the body 1, there is arranged for each sole connecting element, a V-shaped resilient metal strip 10. It has a resilient flange 11 preferably double, located on its central upright part and significantly upwardly oriented. The end of the flange 11 and of the resilient flange 10 are upwardly crooked.

Figure 2:
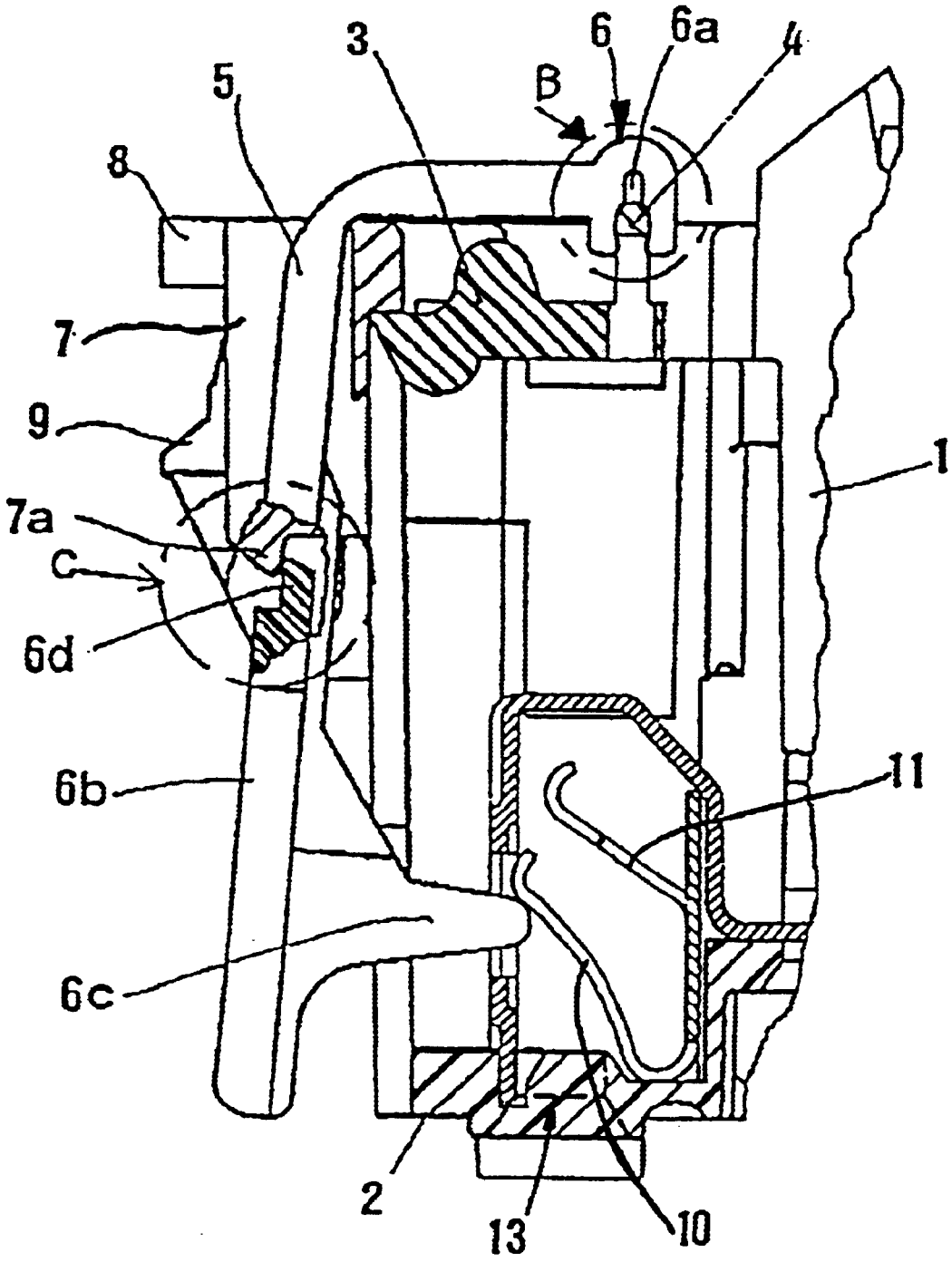
FIG. 2 is a sectional side elevation view through vertical plane 1—1 of half the unit of the preceding figure, showing the position of the elements constituting one of the devices for quick connection to terminals.
Figure 3:
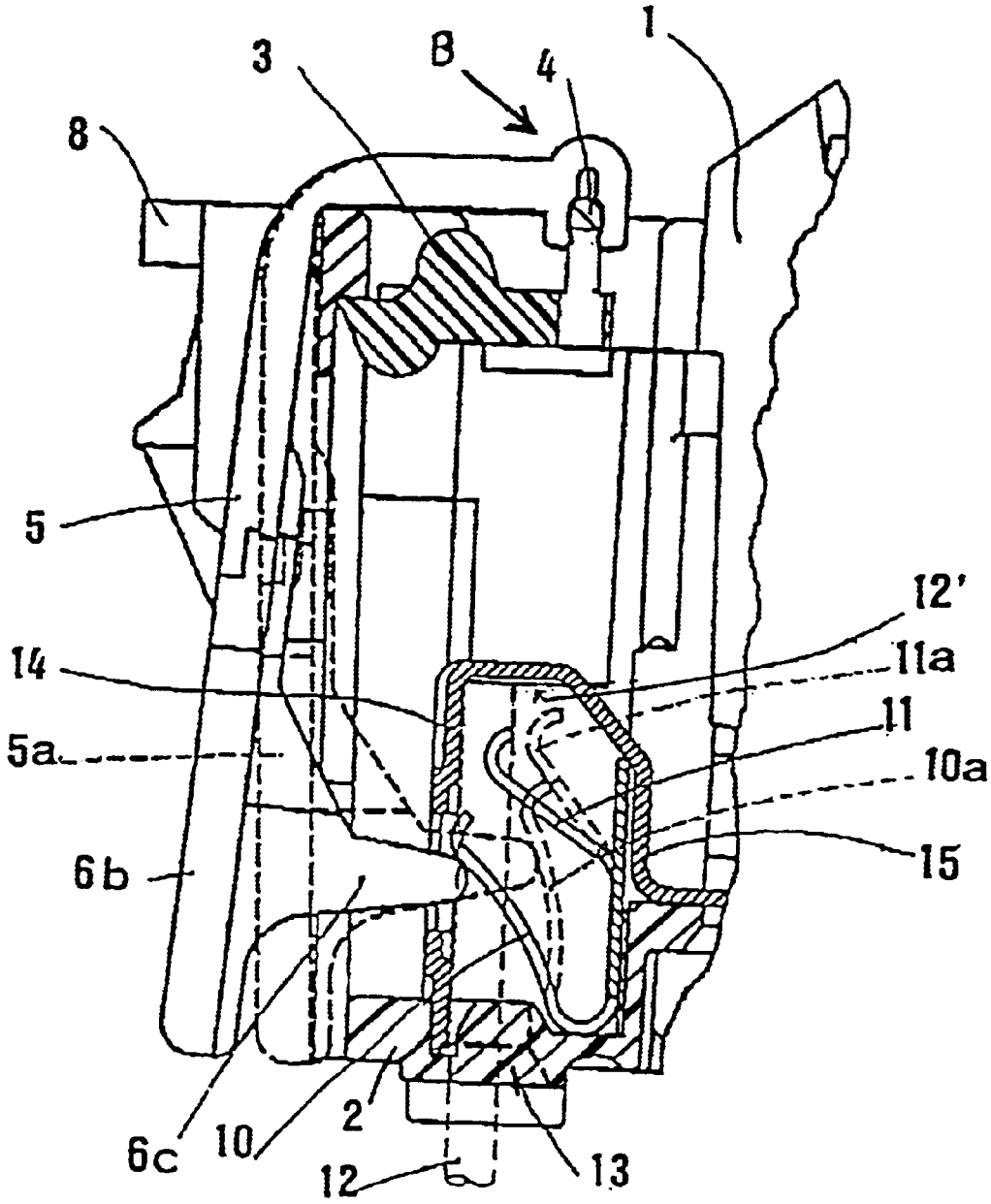
FIG. 3 is a sectional side elevation view, equivalent to FIG. 2 where the initial and operating positions of the device for connecting to terminals are emphasized.
Figure 9:
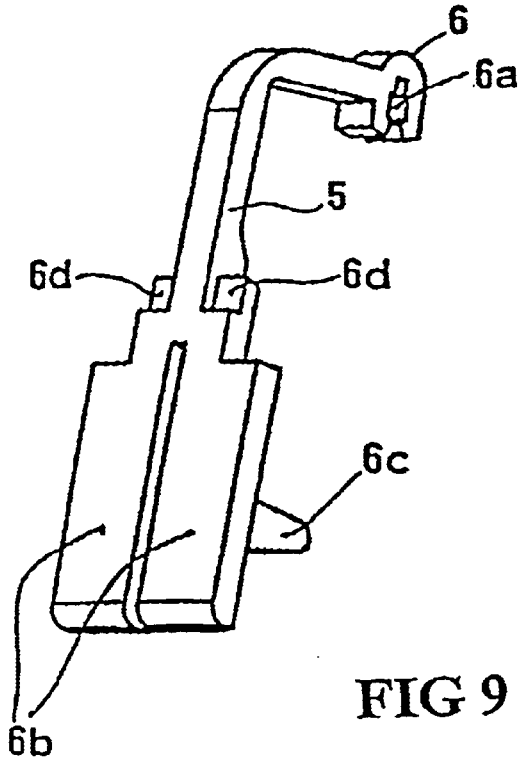
FIGS. 9 and 10 are two views in perspective from different angles of a quick connection of terminal lever.
Figure 10:
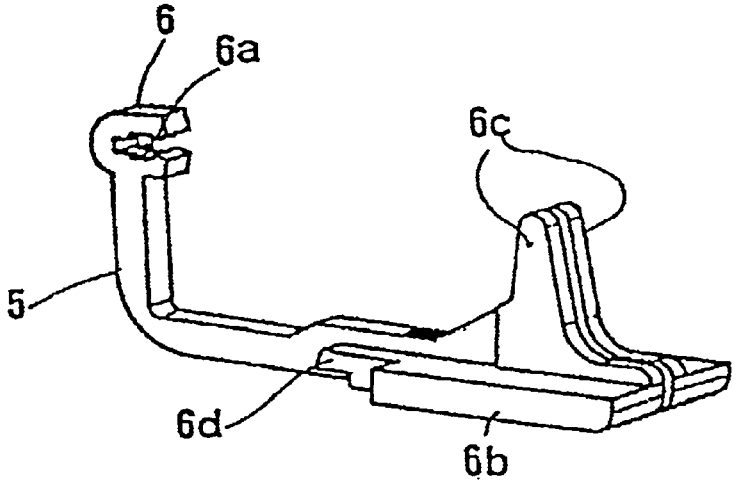

The operating lever 5 is constituted, as it is illustrated in FIGS. 9 and 10, by a body having a quadrangular section, folded in straight angle at its top and having at its end the round head 6 with the slot 6*a* for its setting. The lever 5 is downwardly extended, being widened for constituting the flat surface of the two supporting keys 6*b*, both symmetrical. Below they come inwardly by rounded end protuberances, which are hammer-shaped 6*c*, also spaced and symmetrical. The protuberances remain leaned against the end of the related resilient metal strip 10, which provides that the lever is kept in the initial position, according to FIG. 2.

Finally, the operating lever posseses, at its central part, stepped protuberances 6*d* one on each side of the lever arm. As a retaining or stopping latch they remain leaned against the protuberance 7*a* or the external small wall 7 and prevent that the lever goes out and therefore that it is fully detached.

When it is desired to connect to the terminal the end 12 of a cable, represented by a line of strokes, it will be introduced through one of the holes 13 exiting at the part corresponding to the bottom 2 of the body 1, as illustrated in FIG. 1.

At that moment, the device for connecting to the terminals will be triggered by pressing the corresponding key 6*c* of the lever 5, which provokes inwardly swinging up of the lever to the position 5*a*, moment when the internal protuberance or supporting key 6*b* pushes the resilient metal strip 10 toward position 10*a* and this, in turn, pushes the flange 11 up to position 11*a*. At that moment, the passage is open for the conductive end of cable 12 it is desired to connect to the terminal, which can be introduced up to the back 12' leaning against convex bar-shaped wafer 14. When the lever 5 is released, the flange 11 and the resilient metal strip 10 come back to its initial position, gripping the conductor 12 very quickly and with full contact guaranty.

Connecting with the rest of the electric device is immediately carried out through suitable contact 15, extension of the convex bar shaped wafer 14 on which conductor 12 is gripped at its connection to the terminal place.

Figure 4:
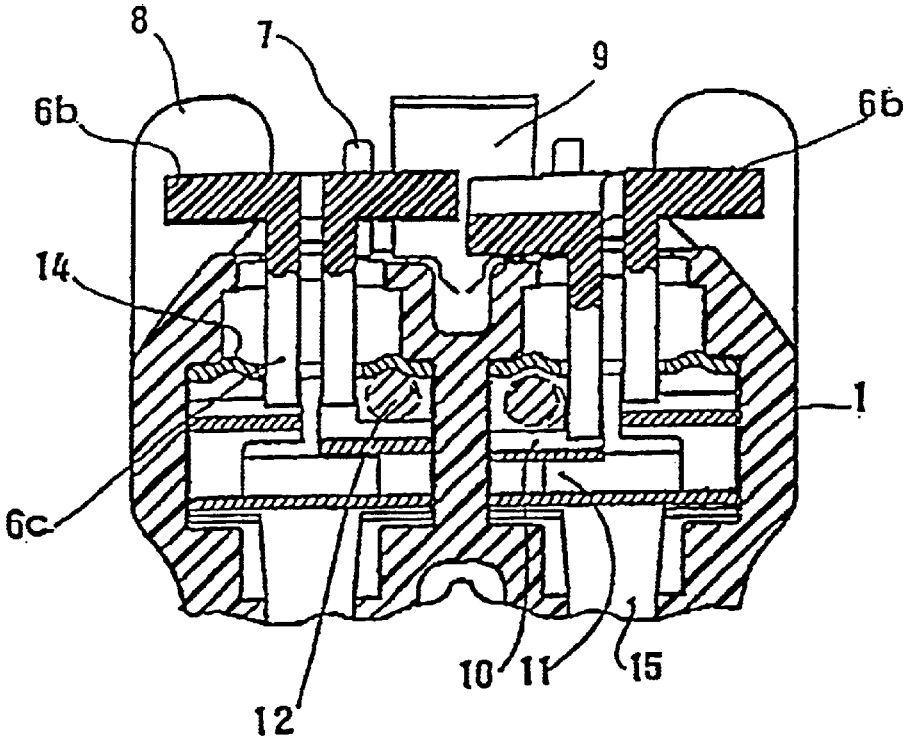
FIG. 4 is another sectional view of the body, through plane II—II, at the body lower area. In this figure only one conductor has been illustrated located at the terminal connecting areas and in one of them, it is drawn in a pressed position a key supporting the operating lever of the device for connecting to terminals.
Figure 5:
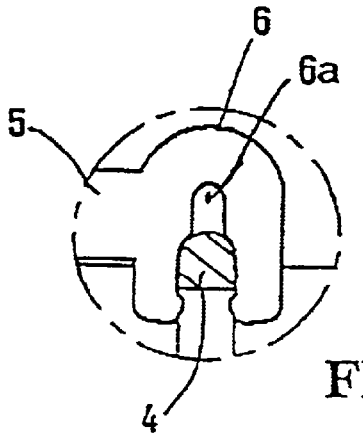
FIG. 5 is a detail, at larger scale, of the fastening area of the operating lever reference B, according to FIGS. 2 and 3.
Figure 6:
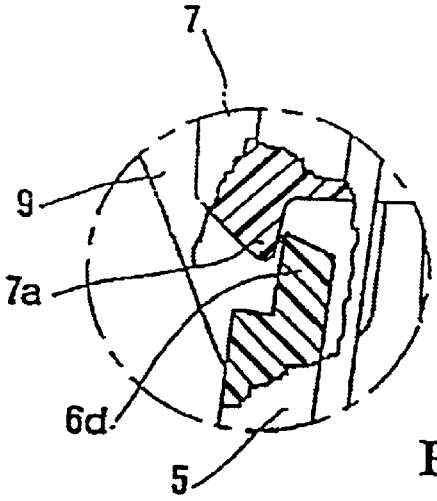
FIG. 6 is another detail, also a larger scale, of the stopping or retaining latch the operating lever possesses, reference C, according to FIG. 2.

According to above, the special arrangement and design of the device for connecting to the terminals, will allow, first, to connect two conductors 12 to a same terminal, for which purpose the convex-bar-shaped contact 14 will have two recesses, one for each conductor, as it can be seen in FIG. 4.

Since the supporting keys 6*b* are differentiated, when pressing one of them, the corresponding resilient metal strip 10 will be triggered, therefore disconnecting the conductor 12 retained by it, without the other is disconnected, unless the other supporting key is pressed.

Also, when two conductors 12 have to be connected from same terminal, it will be possible after connecting one of the two conductors, to connect the other without affecting the first one nor disconnecting it.

Figure 7:
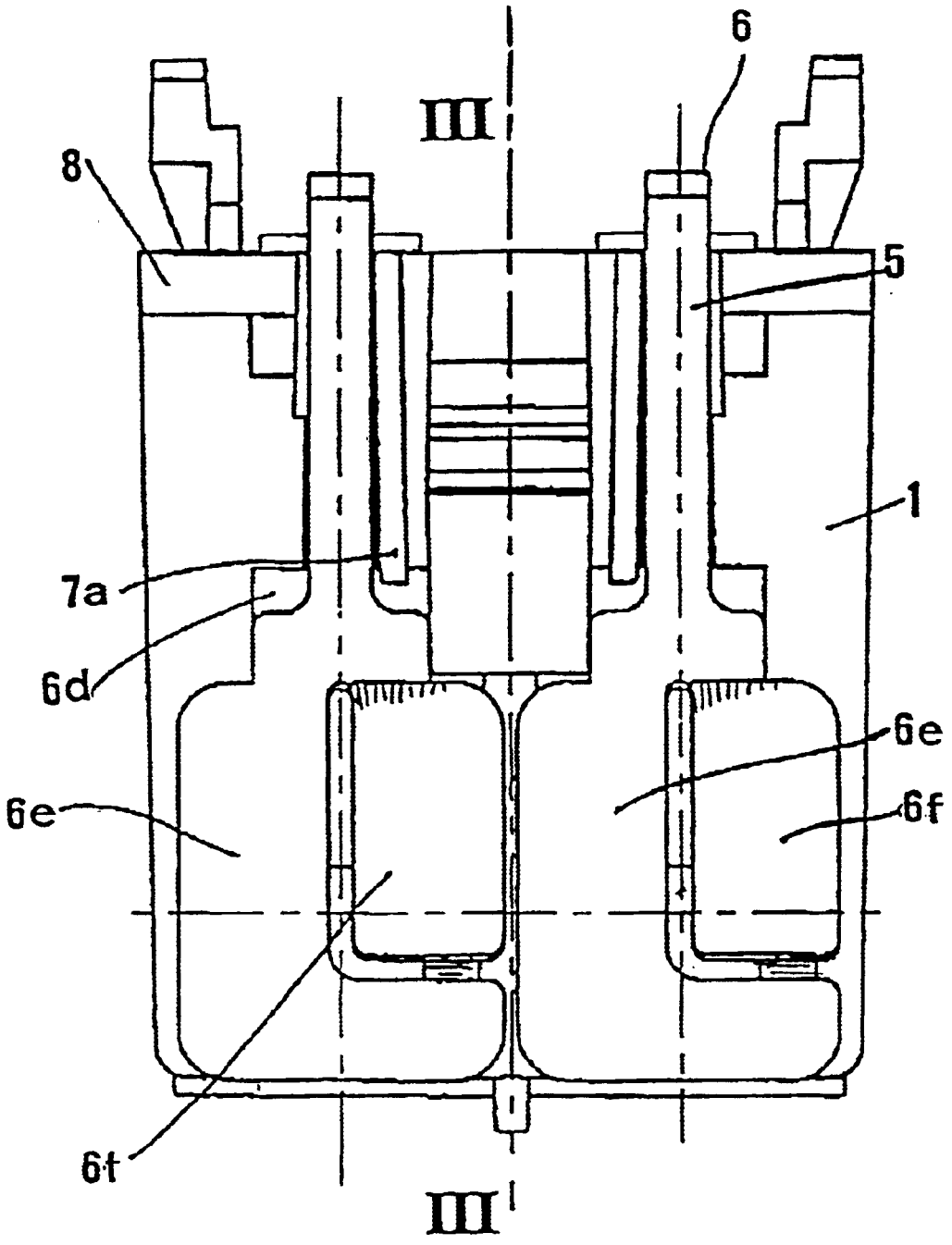
FIG. 7 is an elevational view of the body, similar to FIG. 1, illustrating a variation of embodiment of the operating levers of the quick connection to terminal devices.
Figure 8:
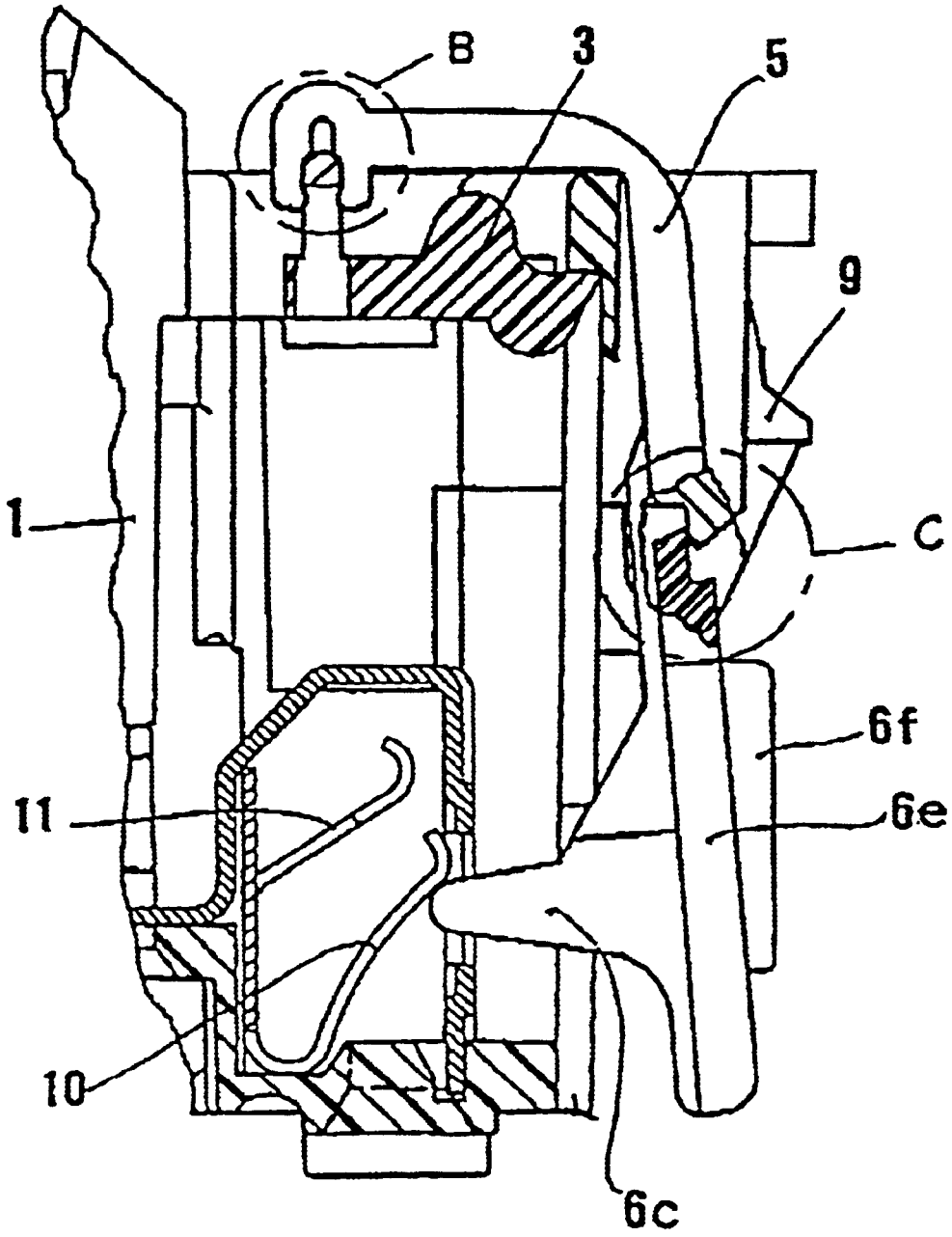
FIG. 8 is a sectional side elevation view through III—III, of the unit corresponding to the preceding figure.

In a variation of embodiment, as it is illustrated in FIGS. 7 and 8, the operating lever 5 possesses different supporting keys, marked with references 6*e* and 6*f*. The first of them is an L-shaped wrapping, which locates it on corresponding resilient metal strip 10 and flange 11 of the device to be connected. When pressing the key 6*e* both will be triggered, while the other key 6*f* covers the rest of the area, remaining located on the other elements corresponding to them.

According to this variation, when pressing the wrapping supporting key 6*e*, the quick connection devices which correspond to them will be triggered, while when pressing the other key 6*f*, the other of the quick connection device located under the same key will be triggered.

Therefore, when connecting two stranded and/or multi-wired and stiff conductors to a same terminal, it is possible after one of the two conductors is already connected, to connect the second conductor so that when pressing its corresponding connecting key, it does not affects and/or does not disconnect the first conductor.

It is obvious that the invention does not require at any moment screws for connecting as it was usual until now, which allows to operate independently each time.

The object of the unit for connecting to terminals having been sufficiently disclosed, it must be said that any variation of sizes, shapes and external appearance as well as any kind of materials used for the embodiment of the said unit for connecting to terminal, shall absolutely not impair its spirit which is summarized in following claims.

It will be understood that each of the elements described above, or two or more together, may also find a useful application in other types of constructions differing from the types described above.

While the invention has been illustrated and described as embodied in unit for connecting conductor terminals, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A unit for connecting conductors to a terminal, comprising a single body having a bottom, said single body being formed so that simultaneously two conductors can be introducible into said body; and means for connecting the two conductors introduced into the single body to said terminal and disconnecting one of the introduced conductors without disconnecting the other conductor as well as connecting to the terminal one of the conductors and thereafter the other conductor also without the one conductor being affected, with said means acting on the conductors perpendicularly to said bottom of said body, said means including two operating levers each having two integrally formed keys pressable independently from one another so as to act on the corresponding conductor.

2. A unit as defined in claim 1, wherein said body is formed as a substantially rectangular prismatic body having a substantially flat bottom and substantially upright protuberances for setting and swinging said operating levers, said body having walls which form an interior of said body for receiving electrical elements to which the unit is to be coupled, and externally having substantially upright walls determining a location of said operating levers.

3. A unit as defined in claim 2, whereineach of said operating levers has a head with a slot for setting, a lower part with a widening which forms said two keys as symmetrical supporting keys and also inwardly rounded hammer-shaped protuberances; a resilient metal strip located in connection area and arranged so that said hammer-shaped protuberances lean against a resilient metal strip, said resilient metal strip being V-shaped and having a central part with a resilient flange and an end with an upwardly crooked extension, so that when a conductor end has to be connected to a terminal and introduced through said bottom, a corresponding one of said keys is pressed so as to inwardly swing said lever and push said hammer-shaped protuberance on said resilient metal strip, and a passage is open for positioning of the conductor supported on a corresponding wafer, and so that when said key is no longer pressed, said resilient metal strip together with said central flange come back to their initial position so as to grip the conductor.

4. A unit as defined in claim 3, wherein said keys of each of said levers are different and are formed so as to carry out in a differentiated way a connection or disconnection of one of the two conductors situated in a single terminal without the other conductor being affected.

5. A unit as defined in claim 2, wherein said one of said keys is formed as an L-shaped wrapping acting on a corresponding resilient metal strip and a flange and when pressed acts by reaction, while the other of said keys is surrounded by said one key and acts on another corresponding metal strip and a flange, so as to affect a connection of a corresponding one of the conductors.

* * * * *